US005225879A

United States Patent [19]

Hayashida

[11] Patent Number: 5,225,879

[45] Date of Patent: Jul. 6, 1993

[54] IMAGE FORMING APPARATUS HAVING A CONVEY GUIDE CHARGED OPPOSITELY TO THE POLARITY OF A DEVELOPING AGENT

[75] Inventor: Masatoshi Hayashida, Kawasaki, Japan

[73] Assignee: Kabushiki Kaisha Toshiba, Kawasaki, Japan

[21] Appl. No.: 856,463

[22] Filed: Mar. 24, 1992

[30] Foreign Application Priority Data

Mar. 29, 1991 [JP] Japan ..... 3-91713

[51] Int. Cl.[5] ..... G03G 15/16

[52] U.S. Cl. ..... 355/274; 250/324; 355/276; 361/214

[58] Field of Search ..... 355/271, 273, 274, 276, 355/219; 361/212, 214, 220, 230; 271/208, 307; 250/324–326

[56] References Cited

U.S. PATENT DOCUMENTS

| | | | |
|---|---|---|---|
| 4,579,441 | 4/1986 | Hart et al. | 361/214 X |
| 4,699,499 | 10/1987 | Hoshika et al. | 355/274 |
| 4,739,363 | 4/1988 | Hoshika et al. | 355/274 |
| 4,893,146 | 1/1990 | Tachibana | 355/315 |
| 4,896,191 | 1/1990 | Ohyabu et al. | 355/271 X |
| 4,903,080 | 2/1990 | Taniguchi | 355/274 |
| 4,994,861 | 2/1991 | Brandon et al. | 355/274 |

FOREIGN PATENT DOCUMENTS

| | | | |
|---|---|---|---|
| 0210374 | 12/1982 | Japan | 355/274 |
| 0134669 | 6/1987 | Japan | 355/274 |
| 0240986 | 10/1987 | Japan | 355/274 |
| 0269966 | 10/1989 | Japan | 355/274 |
| 0276180 | 11/1989 | Japan | 355/274 |
| 0292380 | 11/1989 | Japan | 355/274 |
| 1-304480 | 12/1989 | Japan . | |
| 2-84668 | 3/1990 | Japan . | |

*Primary Examiner*—A. T. Grimley
*Assistant Examiner*—William J. Royer
*Attorney, Agent, or Firm*—Limbach & Limbach

[57] ABSTRACT

An image forming apparatus includes a transfer charger for electrostatically transferring a developing agent image formed on a photoconductive drum onto a paper sheet at a transfer position, and a separation charger for electrostatically separating the paper sheet from the drum. A convey guide is fixed to the separation charger so as to guide the paper sheet separated form the drum in a predetermined direction. The convey guide is formed of a material which is to be charged in a polarity opposite to a charge polarity of the developing agent on the paper sheet upon triboelectric charging between the convey guide and the paper sheet.

4 Claims, 3 Drawing Sheets

IMAGE FORMING APPARATUS HAVING A CONVEY GUIDE CHARGED OPPOSITELY TO THE POLARITY OF A DEVELOPING AGENT

BACKGROUND OF THE INVENTION

1. Field of the Invention

The present invention relates to an image forming apparatus such as an electrophotographic copying apparatus, a printer, and the like and, more particularly, to a transfer type image forming apparatus for electrostatically transferring a developing agent image formed on an image carrier onto a transfer medium.

2. Description of the Related Art

Various image forming apparatuses, each of which forms a toner image as a developing agent image on a photoconductive drum by, e.g., an electrophotographic method, and electrostatically transfers the toner image onto a transfer sheet, have been proposed and put into practical applications.

Normally, in these image forming apparatuses, a toner image formed on the photoconductive drum is electrostatically transferred onto a transfer sheet by corona discharge from a transfer charger, as disclosed in U.S. Pat. No. 4,893,146, for example. Thereafter, the transfer sheet on which the toner image is transferred is electrostatically separated from the photoconductive drum by corona discharge from a separation charger, which is arranged adjacent to the transfer charger.

A convey guide having a plurality of rib-like members is arranged to oppose the separation charger. The transfer sheet separated from the photoconductive drum is guided by the convey guide and prevented from entering the separation charger.

However, in the above-mentioned conventional apparatus, the material of the convey guide is determined regardless of the charged polarity of a developing agent, and the convey guide is triboelectrically charged upon contact with a transfer sheet. In this case, an electric charge electrified on the convey guide disturbs the developing agent image transferred on the transfer sheet, thus often causing an image defect. Since the convey guide is constituted by arranging the plurality of rib-like members at predetermined intervals, when, for example, a halftone image is transferred onto the entire surface of the transfer sheet, blank portions are formed on the image in correspondence with that portions of the transfer sheet which contact the rib-like members. As a result, an image defect occurs, that is, blank lines extending parallel to the travel direction of the transfer sheet appear on the image in correspondence with the number of the rib-like members. In particular, this tendency is conspicuous in a low humidity environment state wherein the transfer sheet has a high resistance.

SUMMARY OF THE INVENTION

The present invention has been made in consideration of the above situation, and has as its object to provide an image forming apparatus which can reliably prevent a transferred image from being disturbed by a frictional charge on a convey guide, and can obtain a good image free from disturbance.

In order to achieve the above object, an image forming apparatus comprises means for forming a developing agent image on an image carrier; means for electrostatically transferring the developing agent image formed on said image carrier onto a surface of a transfer medium at an image transfer portion near the image carrier; means for feeding the transfer medium through the image transfer portion; and a convey guide for contacting that surface of the transfer medium which is opposite to the surface on which said developing agent image is transferred and guiding the transfer medium on a downstream side of the image transfer portion with respect to a feeding direction of the transfer medium. The convey guide is formed of a material, which is to be charged in a polarity opposite to a charging polarity of a developing agent by frictional charging between the convey guide and the transfer medium.

According to the apparatus with the above-mentioned arrangement, a developing agent image on the image carrier is transferred onto an electrified transfer medium by the transfer means, and thereafter, the transfer medium is electrostatically separated from the image carrier by the separation means. The convey guide prevents the separated transfer medium from entering the separation means, and guides it in a predetermined direction. At this time, the convey guide is charged in a polarity opposite to the charging polarity of the developing agent, due to frictional contact with the transfer medium. For this reason, the transferred image can be prevented from being disturbed by an electric charge electrified on the convey guide, and a good image free from disturbance can be obtained.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 4 show an image forming apparatus according to an embodiment of the present invention, in which:

FIG. 1 is a schematic sectional view showing the overall apparatus;

FIG. 2 is an enlarged sectional view showing a transfer section, a separating section, and a portion around these sections of the apparatus;

FIG. 3 is a perspective view of a separation charger and a convey guide; and FIG. 4 is a schematic sectional view showing charging states of the transfer section and the separating section of the apparatus in correspondence with FIG. 2.

DETAILED DESCRIPTION OF THE PREFERRED EMBODIMENTS

An embodiment of the present invention will be described in detail with reference to the accompanying drawings.

Figure 1:
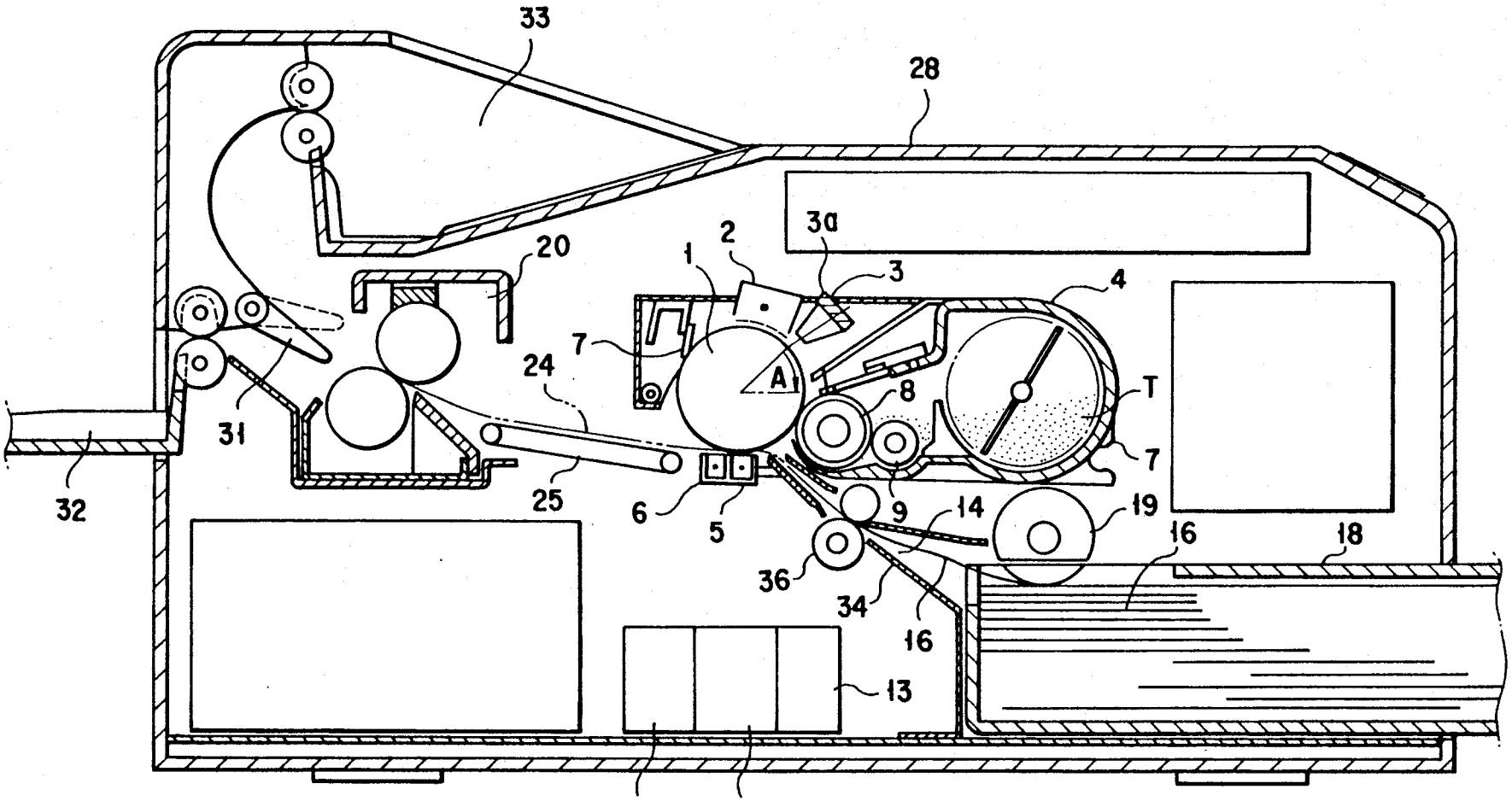

As shown in FIG. 1, an image forming apparatus comprises a housing 28. A photoconductive drum 1 as an image carrier is arranged in substantially the central portion of the housing and rotatable in a direction indicated by arrow A. The outer circumferential surface of the drum 1 is formed of an organic photoconductor (OPC)-based photoconductive material. A main charger 2, an exposure device 3 having a light-emitting diode array (LED array) 3*a*, a developing device 4, a transfer device 5, a separation device 6, and a cleaning device 7 are arranged in this order around the drum 1 in the rotational direction of the drum. The main charger 2 is located above the photoconductive drum 1, and substantially uniformly and negatively charges the surface of the drum 1 to −500 to −800 V. The exposure device 3 radiates LED light onto the surface of the photoconductive drum 1 according to image information to be recorded, thereby forming an electrostatic latent image on a charged region on the drum surface. The developing device 4 comprises a hopper 7 which stores a one-component developing agent (toner) T having triboelectric charging characteristics. In the hopper 7 are arranged a developing roller 8 which is in rolling contact with the photoconductive drum 1 and a rotatable intermediate roller 9 for supplying the toner T to the developing roller 8. The developing roller 8 is connected to a bias power supply 13. In a developing mode, a predetermined bias voltage (−140 to −400 V) is applied to the roller 8. The developing roller 8 supplies the toner supplied from the intermediate roller 9 to the photoconductive drum 1, thereby developing the electrostatic latent image on the drum.

Figure 2:
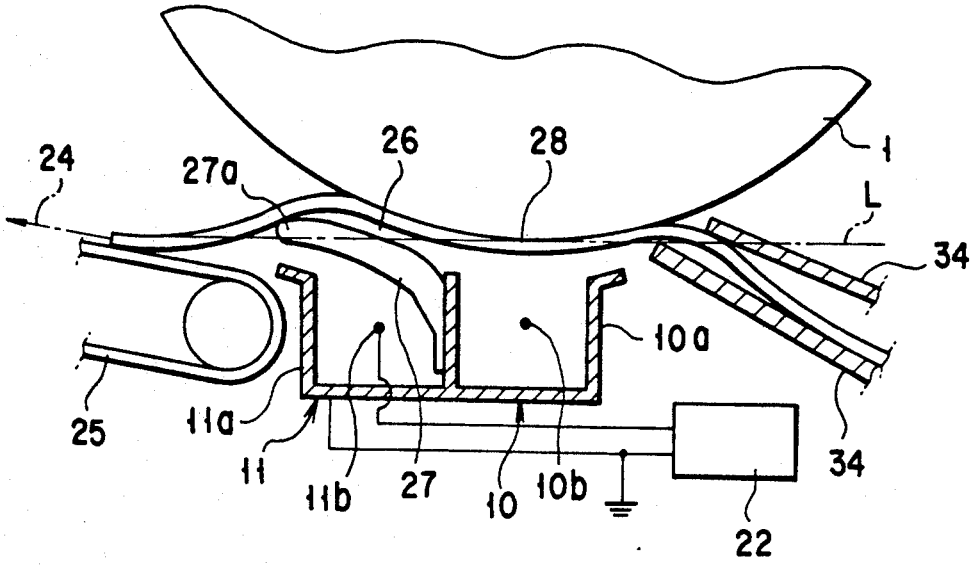

As shown in FIGS. 1 and 2, the transfer device 5 and the separation device 6 are located below the photoconductive drum 1. The transfer device has a DC corona discharger or transfer charger 10, and the separation device 6 has an AC corona discharger or separation charger 11. These chargers 10 and 11 are respectively connected to a DC power supply 21 and an AC power supply 22.

A paper cassette 18 for storing paper sheets 16 as transfer media on which an image is to be transferred is loaded in the lower right portion of the housing 28. In the housing 28 is defined a paper convey path 24 which extends from the paper cassette 18 to a fixing device 20 through a portion between the photoconductive drum 1 and the transfer and separation chargers 10 and 11. The convey path 24 is defined by a plurality of paper guides 34 extending from the cassette 18 to a position near the transfer charger 10, and a conveyer belt 25 extending between the separation charger 11 and the fixing device 20.

Figure 3:
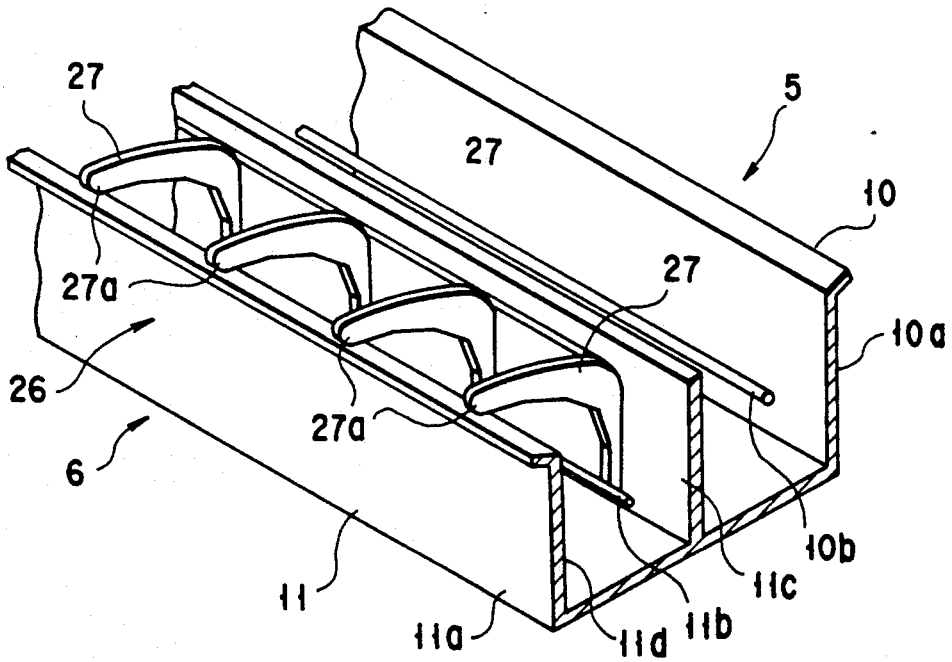

Above the cassette 18 is arranged a paper feed roller 19 for picking up the paper sheets 16 one by one from the cassette 18 upon its rotation, and feeding the picked-up sheet to the convey path 24. Aligning rollers 36 are arranged in the convey path 14 between the cassette 18 and the drum 1. These rollers 36 register the picked-up sheet 16, and then feed it to the drum 1. In addition, these rollers 36 prevent two overlapping sheets from being simultaneously fed. As shown in FIGS. 2 and 3, the transfer charger 10 has a shield case 10*a* having an opening opposing the photoconductive drum 1, and a corona discharging wire 10*b* extending in the shield case to be parallel to the drum. The separation charger 11 has a shield case 11*a* having an opening opposing the drum 1, and a corona discharging wire 11*b* extending in the shield case to be parallel to the drum. The shield case 11*a* is formed integrally with the shield case 10*a* of the transfer charger 10.

A convey guide 26 is arranged between the separation charger 11 and the photoconductive drum 1. The convey guide 26 guides the transfer sheet 16 toward the discharge side of the apparatus, i.e., to the conveyer belt 25 so as to prevent the sheet from entering the shield case 11*a*. The convey guide 26 has a plurality of substantially L-shaped guide plates 27. These guide plates 27 are arranged with predetermined intervals in the axial direction of the photoconductive drum 1. Each guide plate 27 is mounted on a side wall 11*c*, on the side of the transfer charger 10, of the shield case 11*a* of the separation charger 11, and extends from the side wall 11*c* toward the conveyer belt 25 along the convey direction of paper sheets.

An extending end 27*a* of each guide plate 27 is located above an outer side wall 11*d* of the shield case 11*a* of the separation charger 11, and is located at a position nearer the drum with respect to a tangent L of the drum at a position opposing the transfer charger 10, i.e., an image transfer position 28.

Each guide plate 27 of the convey guide 26 is formed of a material, which is to be charged in a polarity (−) opposite to the charging polarity (+) of the toner T upon frictional contact with a transfer sheet 16.

The operation of the image forming apparatus with the above-mentioned arrangement will be described.

Figure 4:
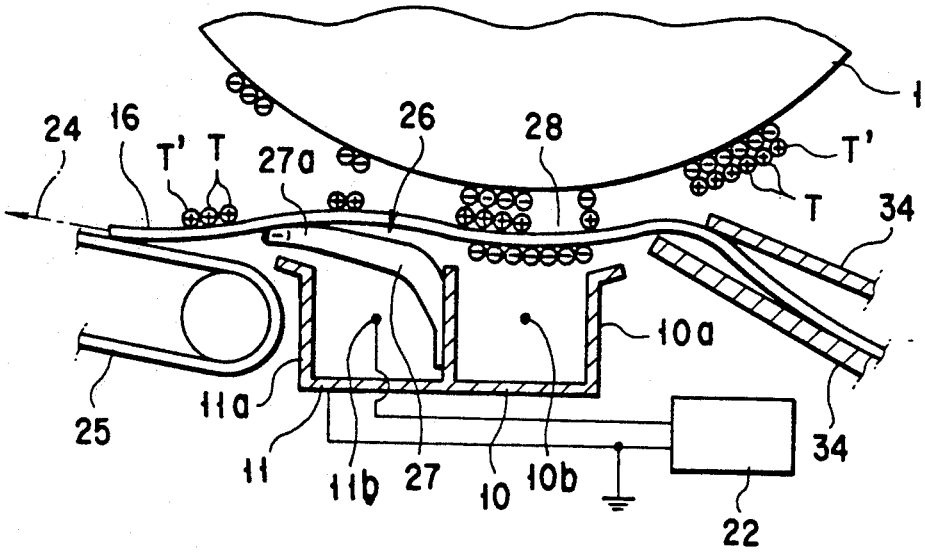

As shown in FIG. 4, a toner image T′ formed on the outer circumferential surface of the photoconductive drum 1 and developed by the toner is fed to the image transfer position 28 upon rotation of the drum. A paper sheet 16 is fed by the paper feed roller 19 from the cassette 18 to the image transfer position 28 through the convey path 24 in synchronism with the rotation of the drum 1. At the image transfer position 28, the back surface of the paper sheet 16 is subjected to DC corona discharge at 5 kV in a polarity (−) opposite to the charging polarity (+) of the toner T by the transfer charger 10. As a result, a transfer potential is applied to the paper sheet 16. Therefore, the toner image T′ on the drum surface is electrostatically attracted to the paper sheet 16, and is transferred onto the paper sheet.

The paper sheet 16 on which the toner image T′ is transferred is subjected to AC corona discharge at 5 kV at its back surface by the separation charger 11, and its potential is discharged to substantially 0 V. Therefore, the paper sheet 16 is electrostatically separated from the photoconductive drum 1. The separated paper sheet 16 is guided by the convey guide 26 so as not to enter the separation charger 11, and is fed to the conveyer belt 25. Furthermore, the paper sheet 16 is conveyed to the fixing device 20 along the convey path 24. The transferred toner image T′ is fixed on the paper sheet 16 by the fixing device 20. Thereafter, the paper sheet 16 is selectively discharged onto a first or second discharge section 32 or 33 by a gate 31 arranged at the discharge side of the fixing device 20.

The charging polarity of the convey guide 26 upon friction contact with a paper sheet will be explained.

As described above, after the toner image T′ on the photoconductive drum 1 is transferred onto the paper sheet 16, the paper sheet is discharged to substantially 0 V by AC corona discharge. Thus, the paper sheet is separated from the drum 1, and is guided to the conveyer belt 25 while sliding on the convey guide 26 arranged above the separation charger 11. At this time, that portions of the convey guide 26 which sliding contact with the paper sheet are triboelectrically charged more or less.

According to the present embodiment, the triboelectric series of a material forming the convey guide 26 is suitably selected so that the convey guide is charged in a polarity opposite to the charging polarity (+) of the toner T upon frictional contact with a paper sheet.

For this reason, the contact portion of each guide plate 27 with the paper sheet 16 is charged in the negative polarity (−), and operates to attract the toner T in the positive polarity (+) on the paper sheet. Therefore, it is possible to prevent an image disturbance, which is generated in a conventional apparatus, such as generation of blank portions in a transferred image due to return of part of the transferred toner onto the photoconductive drum 1 in a conventional apparatus.

The present inventor conducted experiments to clarify the relationships between the types of materials of the convey guide 26 (or guide plates 27) and an image disturbance with respect to a combination of the OPC photoconductive drum 1 in the (−) polarity and toner T in the (+) polarity, and the obtained results shown in a table below.

Supporter Material and Image Disturbance

Electrification Series: ⊕ ← → ⊖; ↓ Paper

| | | 1 | 2 | 3 | 4 | 5 |
|---|---|---|---|---|---|---|
| | | Supporter Material | | | | |
| Paper Type | | Nylon | Poly-styrene (PS) | Polyacetal (POM) | Poly-ethylene (PE) | Teflon |
| A | Front | x | Δ | ○ | ○ | ○ |
| | Back | x | ○ | ○ | ○ | ○ |
| B | Front | x | ○ | Δ | ○ | ○ |
| | Back | x | ○ | ○ | ○ | ○ |
| C | Front | x | Δ | Δ | ○ | ○ |
| | Back | x | ○ | Δ | ○ | ○ |
| D | Front | x | x | ○ | ○ | ○ |
| | Back | x | Δ | ○ | ○ | ○ |
| E | Front | ○ | ○ | ○ | ○ | ○ |
| | Back | ○ | ○ | ○ | ○ | ○ |
| Dimensional Precision | | ○ | ○ | x | x | |

Judgement Result
○ Good (no blank portion)
Δ Fair (slight blank portions)
x Bad (with blank portions)
. OPC photosensitive body was used
. Temperature = 10° C., Humidity = 20%
. Each data was sampled from 5 sheets In the experiments, five types of materials, i.e., nylon, polystyrene, polyethylene, polyacetal, and Teflon, were prepared as the materials for the convey guide 26. As the paper sheet 16, five types of sheets, which are normally used in a plain paper copying machine (PPC), were used. Image formation was performed in a low-temperature, low-humidity environment that easily causes an image disturbance, and images on the front and back surfaces of each paper sheet 16 were checked. The results were as is shown in the table appended hereto. In the table, the five different materials and a paper sheet are arranged in accordance with the triboelectric series. The charge tendency of the paper sheet is present between tendencies [2] and [3] in the table.

As can be seen from these results, in the materials of the convey guide 26, the closer its charge tendency is to the negative end of the series, e.g., Teflon or polyethylene, the less each material caused image disturbance. Specifically, polyethylene and Teflon, whose charge tendencies are closer to the negative end of the triboelectric series than those of the remaining three materials, were negatively charged while in frictional contact with the paper sheet. In other words, Teflom and polyethylene gained the polarity opposite to that of the toner T on the paper sheet, which was positively charged. The results of the image checking suggest that, to form a disturbance-free image, use must be made a material which is to be charged in a polarity opposite to the charging polarity of the toner T transferred onto the paper sheet 16 and which has high ionization potential in the polarity opposite to the charging polarity of the toner T.

This is because, as shown in FIG. 4, the toner T in the positive polarity (+) transferred on the paper sheet 16 is electrostatically attracted by that portion of the convey guide 26 which is charged in the negative polarity (−), and is prevented from being returned to the photoconductive drum 1.

According to this embodiment, as the material of the convey guide 26, a material, which allows a contact portion of the convey guide to be charged in the polarity (−) opposite to the charging polarity (+) of the toner T transferred on a paper sheet upon frictional contact with the paper sheet 16, was selected. More specifically, when the OPC photoconductive drum 1 was used, the charging polarity of the toner T just after the developing process and at a position of the convey guide 26 is positive (+). Thus, the convey guide 26 was molded using a material whose charge tendency was located on the right side of that of the paper sheet in triboelectric series shown in the table, i.e., a material having a lower charge tendency than that of a paper sheet, e.g., polyethylene or Teflon having the electrification tendency [4] or [5].

The contact portion of the convey guide 26 which frictionally contacts with a paper sheet has different charge amounts depending on the charge tendencies of its materials. For this reason, it is advantageous to use a material, which is to be charged in a larger charge amount to have a polarity opposite to the polarity of the toner T on the paper sheet 16.

When the convey guide 26 is molded using a material whose charge tendency is on the left side of that of the paper sheet upon triboelectric charging between the convey guide and the paper sheet, e.g., nylon having the charge tendency [1], the convey guide is charged in the (+) polarity opposite to the above-mentioned case. The back surface of the paper sheet 16, which contacts the convey guide 26, is charged in the (−) polarity. For this reason, it is expected that the toner T in the (+) polarity transferred onto the paper sheet 16 is attracted to the paper sheet 16, and stays on the paper sheet.

However, in practice, in the triboelectric charging state between the paper sheet 16 and the convey guide 26, since the paper sheet 16 is conveyed and moved, and the convey guide 26 is fixed in position, the paper sheet 16 and the convey guide 26 have quite different charging times. Since a specified portion of the fixed convey guide 26 is consecutively charged while the paper sheet 16 is being conveyed, the charge amount of the convey guide is considerably larger than that of the triboelectrically charged portion of the moving paper sheet. Thus, an electrostatic force acts on the toner T in the (+) polarity transferred on the paper sheet 16 in a direction wherein the toner separates from the paper sheet. At the same time, since the toner T in the (+) polarity is located between the convey guide charged in the (+) polarity and the photoconductive drum 1 charged in the (−) polarity, the toner T is easily moved toward the photoconductive drum 1 due to a DC electric field between the convey guide and the photoconductive drum.

Furthermore, when an AC electric field is applied from the separation charger 11 to the DC electric field, the flying effect of toner particles due to AC discharge is added. As a result, the toner T on that portion of the paper sheet 16 which opposes the triboelectrically charged portion of the convey guide 26 is returned to the surface of the photoconductive drum 1. For this reason, only the corresponding portion of the transferred image is omitted as a blank portion. This phenomenon tends to particularly occur in a halftone image in which a layer of the toner T on the paper sheet is thin.

However, according to this embodiment, as described above, since a material, which is to be charged in a polarity opposite to the charging polarity of the toner T, is employed as the material of the convey guide 26, good image formation free from a disturbance can be performed without causing a blank phenomenon of the transferred image.

According to the image forming apparatus with the above arrangement, the distal end portions (extending ends) 27*a* of the guide plates 27 of the convey guide 26 extend to a position nearer the drum side than the tangent L of the photoconductive drum 1 at the image transfer position 28. For this reason, the paper sheet 16 can be kept in contact with the photoconductive drum 1 by a predetermined length by the convey guide 26 after it passes the image transfer position 28. Therefore, the contact length between the paper sheet 16 and the photoconductive drum 1 can be prolonged, thus improving transfer efficiency The present invention is not limited to the above embodiment, and various changes and modifications may be made within the spirit and scope of the invention.

For example, the material of the convey guide need only be triboelectrically charged in a polarity opposite to that of a toner transferred on a paper sheet, and is not limited to the above-mentioned Teflon, polyethylene, and the like.

In the above embodiment, a case has been described wherein a toner transferred onto a paper sheet has the positive polarity. However, when the toner has the negative polarity, the convey guide is formed of a material, which is charged in the positive polarity upon triboelectric charging with the paper sheet. More specifically, the convey guide is formed of a material having a charge tendency closer to the positive end of the triboelectric series than that of the paper sheet.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus comprising:

means for forming a developing agent image on an image carrier;

means for electrostatically transferring the developing agent image formed on said image carrier onto a surface of a transfer medium at an image transfer portion near the image carrier;

means for feeding the transfer medium through the image transfer portion;

electrostatic separating means having an AC corona discharger for electrostatically separating the transfer medium, on which the developing agent image is transferred, from the image carrier; and a convey guide for contacting that surface of the transfer medium which is opposite to the surface on which said developing agent image is transferred and guiding the transfer medium on a downstream side of the image transfer portion with respect to a feeding direction of the transfer medium through the electrostatic separating means, said convey guide being formed of a material, which is to be charged in a polarity opposite to a charging polarity of a developing agent on said transfer medium upon frictional charge between said convey guide and said transfer medium, and said convey guide having a contact portion for contacting said transfer medium, the contact portion extending to a position nearer the image carrier than a tangent of the image carrier at the image transfer portion.

2. An apparatus according to claim 1, wherein said image forming means comprises means for charging said image carrier in negative polarity, and developing means for supplying a developing agent in positive polarity to said image carrier, and forming the developing agent image in the positive polarity, and the material of said convey guide has a charge tendency closer to a negative end than a charge tendency of said transfer medium.

3. An apparatus according to claim 1, wherein said transferring means includes a transfer charger having a shield case, which is located to oppose the transfer portion of said image carrier and has an opening opposing said image carrier, said separating means includes a separation charger having a shield case, which is located at a downstream side of said transferring means with respect to a convey direction of said transfer medium and has an opening opposing said image carrier, and said convey guide is fixed to said shield case of said separation charger, and extends over the opening of said separation charger.

4. An apparatus according to claim 3, wherein the shield cases of said transfer and separation chargers are formed integrally with each other to have a common side wall, and said convey guide has a plurality of guide plates extending from said side wall in the convey direction of said transfer medium.

* * * * *